United States Patent [19]

Cailey

[11] 4,070,954

[45] Jan. 31, 1978

[54] DUCT FORMING MACHINE

[75] Inventor: Ronald J. Cailey, San Antonio, Tex.

[73] Assignee: Glass Master Corporation, San Antonio, Tex.

[21] Appl. No.: 627,376

[22] Filed: Oct. 30, 1975

[51] Int. Cl.[2] ..... B31B 3/60; B31F 1/00

[52] U.S. Cl. ..... 93/36.9; 53/137; 93/56 PD

[58] Field of Search ..... 93/56 PD, 94 PS, 56 R, 93/36.9, 41.1, 82, 52, 1 E, 1 F; 156/552, 92; 53/137

[56] References Cited

U.S. PATENT DOCUMENTS

| | | | |
|---|---|---|---|
| 929,450 | 7/1909 | Langston | 93/56 R |
| 1,417,651 | 5/1922 | Woehr | 93/1 F |
| 3,199,262 | 8/1965 | Miller et al. | 93/56 R |
| 3,800,679 | 4/1974 | Bartelheimer | 93/36.9 |
| 3,908,526 | 9/1975 | Vassalos | 93/82 |

*Primary Examiner*—Z. R. Bilinsky
*Attorney, Agent, or Firm*—Vinson & Elkins

[57] ABSTRACT

A machine for fastening the flap of a duct board previously cut in a manner to permit it to be folded into duct form; such machine being capable of stapling the flap to the side edge of the board if desired and of applying a sealing tape to the flap and adjacent other edge of the duct board to complete the forming and sealing of a piece of duct board into a duct.

11 Claims, 4 Drawing Figures

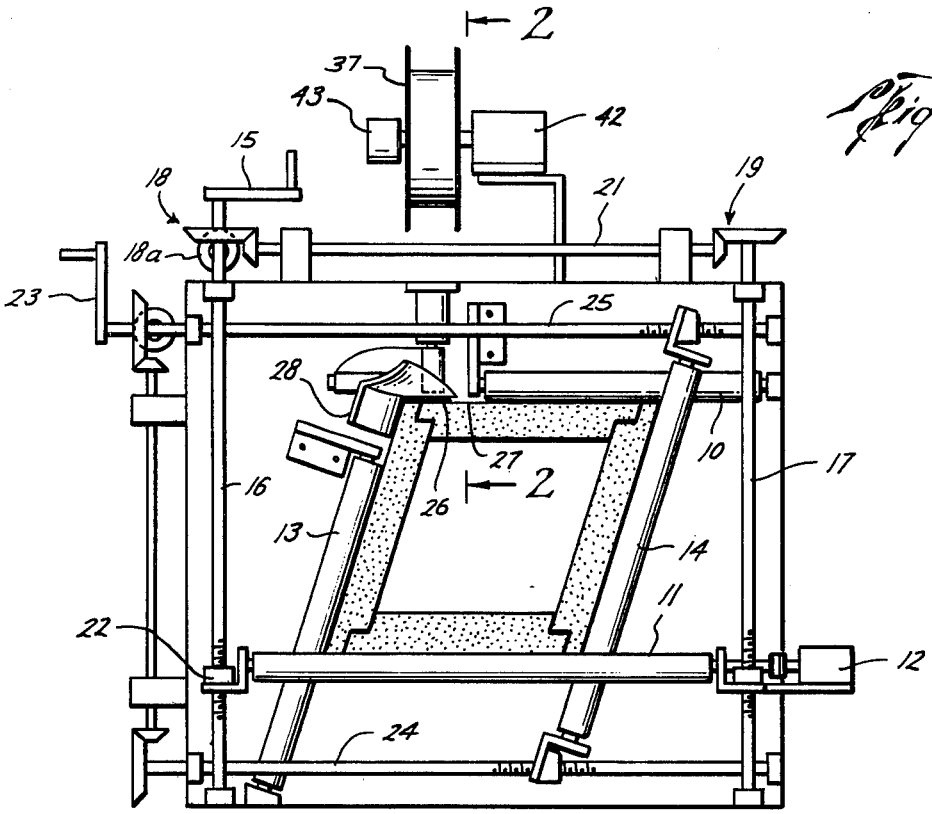
Fig. 1
Fig. 2
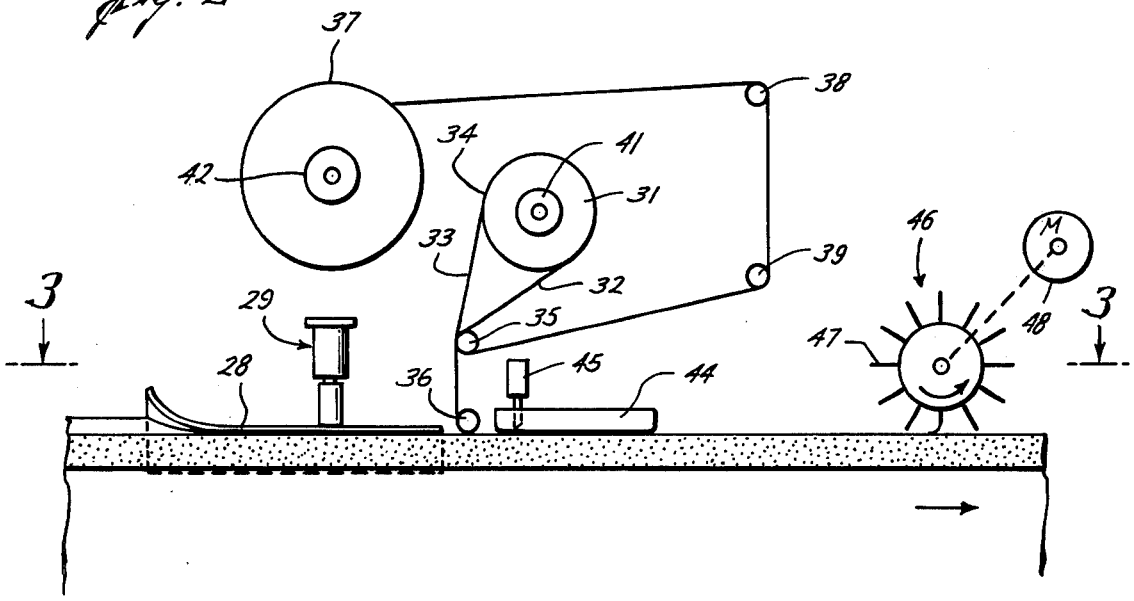

DUCT FORMING MACHINE

This invention relates to machines for forming duct board into a finished duct.

An object of this invention is to provide a machine for taking previously grooved and folded duct board and fastening the flap on one side of the duct board to the other side of the duct board to complete the fabrication of a piece of duct board into a duct.

Another object is to provide a duct forming machine in which after a tape has been applied to the duct the tape is firmly, thoroughly, and evenly applied to the duct board in a manner providing superior strength as compared to hand wiping or mechanical scraping systems.

Another object is to provide in a duct forming machine a means for holding the flap in a position to be attached to the other side of the duct board.

Another object is to provide a duct closing machine which will both staple the flap to the other side of the board and will apply sealing tape over the flap and the other side of the board to seal the longitudinal seam in the duct.

Another object is to provide a duct forming machine in which the duct is rigidly supported in parallelogram form to allow minimum folding and insertion handling of the duct.

Another object is to provide a duct forming machine having a flap guide which folds and aligns the flap and provides rigidity to the duct board so that staples and/or tape can be applied properly.

Another object is to provide a duct forming machine in which tape is applied with a smoothing iron which may be utilized to apply heat if desired.

Another object is to provide a duct forming machine in which the tape is held in alignment as it is applied.

Another object is to provide a duct forming machine in which adjustable tension is applied to tape and to the system for pulling facing from the tape without hindering the tape flow.

Another object is to provide a duct forming machine in which tape is sheared from the duct after it is formed in a manner which prevents curling and sticking of the sheared tape.

Another object is to provide a tape wiper which wipes the tape several times as the duct moves through the machine to provide a superior application of the tape to the duct board.

Other objects, features, and advantages of the invention will be apparent from the drawings, the specification, and the claims.

In the drawings wherein an illustrative embodiment of this invention is shown, and wherein like reference numerals indicate like parts, FIG. 1 is a front elevation view of the machine of this invention, showing in cross-section a folded duct board passing through the machine and being formed into a duct;

FIG. 2 is a fragmentary view along the line 2—2 of FIG. 1 illustrating the mechanism for stapling and ironing the flap to the opposite edge of the board and wiping the tape over the flap and opposite edge of the board;

Figure 3:
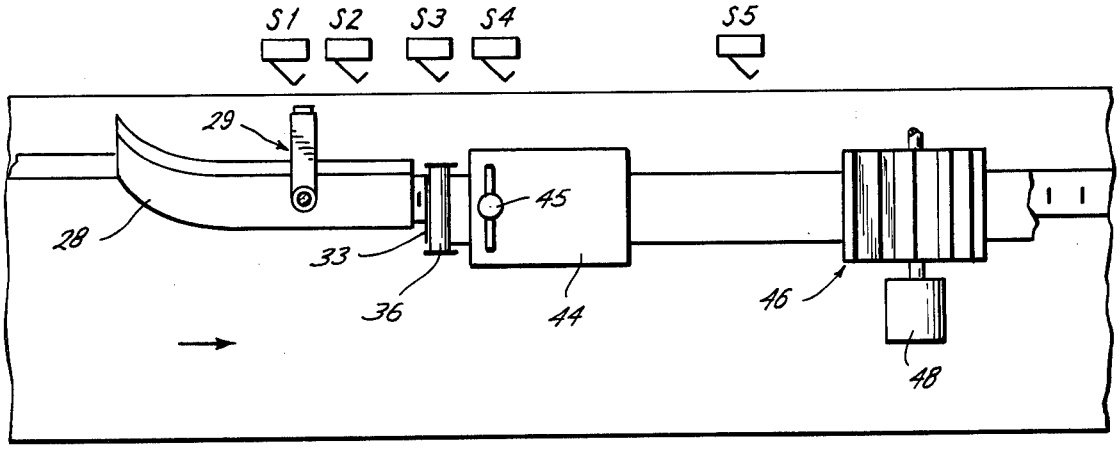
FIG. 3 is a schematic view illustrating the relationship of the several operative components of the machine and the micro-switches for controlling the operation of these components.

Referring first to FIG. 1, the duct closing machine includes a plurality of rollers for guiding the duct board which has been folded into duct form through the machine. Preferably the rollers are arranged in parallelogram form as shown so that after the duct is formed it will return to approximately a rectangular shape. The corner of the duct at which the seam is to be closed is at an obtuse angle slightly more than 180° but the amount of this angle is not critical and the seam could be closed with the duct in rectangular form if desired, but it has been found that with the slight obtuse angle at the seam the duct after being closed will assume approximately a rectangular shape when unstressed. This characteristic is due to the manner in which the duct is cut to form the several corners. The duct is formed in the manner illustrated in the patent to Barr U.S. Pat. No. 3,605,534.

The upper roller assembly for holding duct board in the desired form as it passes through the machine includes roller 10. Only the lead roller is shown, but it will be understood that there are a plurality of rollers behind and in line with this particular roller. In like manner, a roller assembly of which the lead roller 11 is a part is positioned to support the bottom of the duct in the desired manner. Again, there are a plurality of these rollers extending generally through the machine.

In order to provide for smooth flow of the duct through the machine at a constant speed, the lower roller assembly is provided with a means for rotating at least one of the rollers. Such means is shown at 12 and may be provided by an electric motor. Preferably several, if not all, of the lower rollers will be ganged together and driven by the motor 12 so that all will provide a motive force to the duct.

In like manner, a roller assembly, including the lead roller 13, is provided to the left of the duct and a roller assembly including the lead roller 14 is provided to the right of the duct to hold the slightly inclined from the vertical sides of the duct in the desired position. The assemblies 13 and 14 will also include a plurality of rollers extending along parallel planes a substantial distance into the machine for positioning and supporting the duct.

Fiberglass ducts are cut in many sizes and to provide for closure of any desired size of duct, the roller assemblies which include rollers 11 and 14 are adjustable toward and away from roller assemblies which include rollers 10 and 13 respectively. To provide for horizontal adjustment of the lower roller assembly, handle 15 is rotated. This handle directly drives threaded shaft 16 and through the gear assembly indicated generally at 18 and 19 drives threaded shaft 17. Through gear **18*a* of gear assembly 18, another pair of shafts identical to shafts 16 and 17 and positioned immediately behind shafts 16 and 17 are also driven. As in the case of shaft 17, power is transmitted through a shaft (not shown) which is identical to shaft 21. Rotation of these four vertical shafts which are arranged in rectangular form causes the lower roller assembly to move along the shafts as the threaded shafts are rotated through nuts 22** at the four corners of the roller assembly.

In like manner, the roller assembly carrying the lead roller 14 is adjustable horizontally by rotation of crank 23. Rotation of this crank operates a substantially similar drive train to that just explained except for its orientation and results in the rotation of four rectangularly arranged threaded shafts, two of which are shown at 24 and 25 to move the right-hand roller assembly horizontally.

As shown in the Barr patent, fiberglass is removed from a flap of material along one side of the duct board and this flap is secured to the opposite side of the duct board preferably by both stapling and taping. The flap is made of a flexible material which will readily bend as shown. In order to bend the flap 26 into firm engagement with the other side edge 27 of the duct board, a sled guide 28 is provided. As shown in FIGS. 1 and 2, the sled guide 28 is a generally elongate angular piece of metal which along most of its length conforms to the angle of the duct board shown in FIG. 1; that is a slight obtuse angle. At the leading edge of the guide both sides of the guide are flared outwardly for ease of insertion of the duct board and to smoothly bend the flap 26 down into engagement with the other side of the duct board. Also this long sled guide firmly holds the two side edges of the duct for fastening together.

While it is not absolutely necessary to staple the two side edges together, it is preferred to do so as the staples provide additional strength to the duct. In order to apply staples, a staple gun, indicated generally at 29, is provided. This gun is preferably specially designed to hold a large number of staples and preferably has a sled nose design to facilitate the application of staples to a moving duct. The staple gun may be operated in any desired fashion, such as pneumatically, to apply staples at spaced intervals along the duct as it is passing through the machine. For instance, the gun is preferably adjustable to apply staples within a 1 inch to 12 inch spacing as desired.

After staples have been applied, or if no staples are to be applied, the seam is taped by laying a tape longitudinally of the duct and over the flap 26 and the adjacent face of the other side of the duct board. This tape may be fabricated of any desired material such as heat or pressure sensitive foil tape and provides not only strength for the joint but completes the seal between the flap and the impermeable surface of the other side of the duct board.

To supply tape, a tape feed system is provided which positions the end of a tape in line with the duct and in a position to be contacted by the lead end of the duct and pulled with the duct as the duct moves through the machine. The tape feed system also guides the tape to ensure that it is properly laid down and positioned to form the desired seam. Where the tape includes a facing strip provision is made to remove this strip. Referring particularly to FIG. 2, a supply of pressure sensitive tape is provided in the form of a roll of tape 31. This tape has a facing strip 32 which must be removed from the tacky side of the tape as it leaves the roll. The tape 33 is pulled from the roll and leaves the roll approximately at point 34. The tape passes down over idler roll 35 and between flanges on the opposite ends of the idler roll 35 to correctly position the tape. The tape also passes over a similar idle roll 36 which also has side flanges to guide the tape. The tape is extended down a short distance below the idler roll 36 and in the path of the duct board as it passes through the machine.

The facing take-up system includes the take-up roll 37, the two idlers 38 and 39, and the previously-referred-to idler 35. The facing passes first over idler 35 and thence to idlers 39 and 38 and to the take-up roll.

The supply roll 31 is mounted on a suitable adjustable tensioning feed device 41 so that resistance to movement of the tape from the supply can be controlled. In like manner the facing tape take-up reel 37 is driven by motor 42 through a suitable adjustable tensioning device 43 so that the facing may be pulled from the tape without interfering with its smooth application to the duct board.

Immediately after the tape is applied to the board, it preferably passes in contact with a smoothing iron 44. This iron smooths the tape and provides an initial pressing of the tape into contact with the duct board. Where temperature sensitive tape is utilized, this iron will include a heating element to provide the desired heat for the heat sensitive tape. The iron 44 is not necessarily made from "iron" but may be fabricated from other materials.

After the duct passes idler roll 36, the tape applied to the duct should be cut free from the supply and for this purpose a guillotine-type cutter means 45 is supplied. The cutter 45 is preferably positioned to strike downwardly through a slot in the smoothing iron 44. This prevents curling and sticking of the free end of the supply tape as the iron will strip the tape from the knife as it retracts.

In closing a duct board by hand, it is customary to apply the pressure sensitive tape and then smooth the tape firmly into contact with the duct board by wiping the tape with a plastic spatula. It is generally accepted that the more the tape is wiped, the better the initial strength of the joint and also the better the final strength of the joint.

In order to wipe the tape into firm engagement with the duct board, a wiper means is supplied which firmly presses the tape into the duct board after it has passed the smoothing iron 14. In accordance with this invention, the wiper means is preferably provided by a means which provides multiple wipes to the tape such as the paddle wheel indicated generally at 46, having a plurality of flexible paddles 47. The wheel 46 is driven by motor 48 preferably in a counter-clockwise direction as viewed in FIG. 2; that is, with the blades wiping the duct in its direction of movement. By providing one or more paddle wheels 46 and rotating the wheel 46 at a peripheral speed greater than the rate of flow of the duct through the machine, each section of tape may be wiped several times by a paddle 47. Preferably the wiper motor 48 includes a brake which is energized when the motor stops so that the wiper will be effective when stopped. This will ensure that as much air is wiped from under the tape is possible and that the tape is firmly wiped into engagement with the duct board. The result is a bond which is much superior to any hand wiping method.

Figure 4:
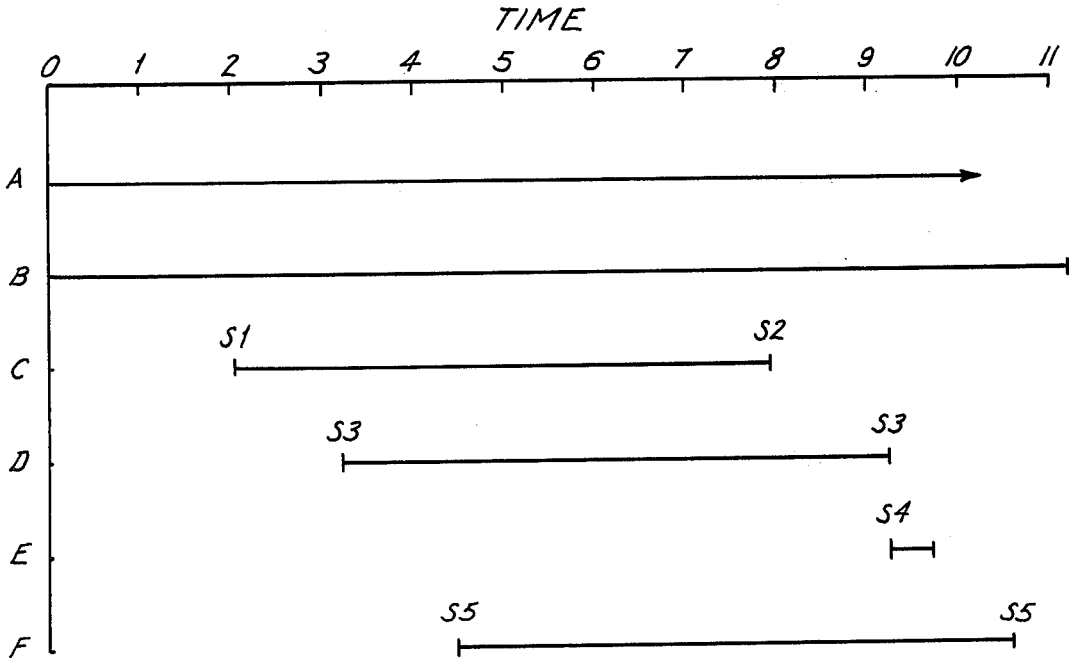
FIG. 4 is a time-function diagram showing the point in time in which the several micro-switches are operated to control operation of the duct forming machine.

FIGS. 3 and 4 illustrate the control of the several operative components of the closing machine. The operative components are controlled by micro-switches S1 through S5, which are positioned in approximately the positions shown in FIG. 3 to be engaged and disengaged by the duct board; that is, the switch elements are engaged by the duct board as it passes through the machine and after the board passes a particular switch, the switch element is disengaged to thus make and break the micro-switch contact in the conventional manner.

In FIG. 4, the system is illustrated for pressure sensitive tape and line A represents the run button which is turned on to operate motor 12 (FIG. 1) and begin rotation of the rollers of the roller assembly to drive the duct through the machine. If heat sensitive tape is used, the run button will not be energized until after the heat iron has attained the desired temperature. Line B represents the duct passing through the machine and as shown the duct is processed in slightly over 11 seconds.

The staple gun 29 is controlled by micro-switches S1 and S2 as indicated by line C. As micro-switch S1 is closed, the leading edge of the duct board is under the staple gun and the staple gun commences firing. As the duct moves through the machine, mirco-switch S2 is closed. This may be used to operate lights on the control panel to indicate the position of the duct but is not utilized to control any of the operative components. After the duct passes micro-switch S2, this switch breaks and de-activates the staple gun. It will be positioned so that de-activation occurs immediately after the last staple is applied to the duct board.

Micro-switch S3 controls the facing or backing paper take-up and as switch S3 is closed, the drive motor 42 for the facing take-up reel is activated to start the reel rotating as the leading edge of the duct board engages the tape 33 and begins to pull it from the supply source. If heat sensitive tape is used which does not require a facing or backing, the facing take-up assembly and micro-switch S3 may be omitted. This function is indicated at FIG. 4 at D and shows that make of S3 begins operation and break of S3 stops the operation of the take-up reel.

The cut-off function is illustrated at E. The micro-switch S4 does nothing on make and breaks immediately after the board passes the knife 45. On break of S4, the solenoid-operated guillotine knife 45 energizes for approximately a half second to cut the tape on the board free from the supply.

At F the operation of the wiper motor 48 is illustrated. The motor begins rotating before the duct reaches the wiper blades and for this reason the blades should be wiping in the direction of movement of the board; otherwise, they might tend to wipe the end of the tape off the board. The wiper motor continues to operate until the board passes the micro-switch. As shown in FIG. 4, the motor is operated up until the last half second of passage of the duct board through the machine. The motor is turned off before the end of the board reaches the paddle to prevent the paddles lifting the end of the tape free from the duct board. The brake is operating to hold the wheel against rotation and the last increment of tape is wiped by a fixed wheel. It will be apparent that in the like manner the paddle wheel could rotate in the opposite direction and commence rotation immediately after the lead edge of the duct board has passed the paddle so that there would be no tendancy to lift the leading edge of the tape from the board. In such instance the paddle wheel could continue to operate until after the trailing edge of the board had passed the paddle. It is of course obvious that if a tape is used which will not be pulled from the board by the paddle wheel, it could be operated over the entire length of the duct.

In the event that staples are not desired, the machine less the staple gun would be operated and utilized as shown.

In addition to the elimination of the staple gun, the facing take-up system could also be eliminated where tape without a facing is utilized.

While a guillotine-type cut-off knife is illustrated, it will of course be apparent that other types of cutters could be used.

While an elongate smoothing iron is preferred, a short wiping section, or roller, could be utilized to merely initially wipe the tape into contact with the duct board as it passes through.

The rotating paddle wheel wiper is preferred as is a ready easy means of applying multiple wipes to the tape. It is apparent, however, that other wiping means could be provided in which wiper paddles or blades would be applied to the duct board and the board wiped several times as it passes through this portion of the machine.

The foregoing disclosure and description of the invention are illustrative and explanatory thereof, and various changes in the size, shape, and materials, as well as in the details of the illustrated construction, may be made within the scope of the appended claims without departing from the spirit of the invention.

What is claimed is:

1. A duct closing machine comprising, a plurality of rollers arranged in parallelogram form to guide a duct board folded in duct form through the machine, said board having a flap of material on one side thereof, means rotating at least one of said rollers to move the duct board through the machine, a sled guide on the machine bending and holding the flap on one side of the duct board in engagement with the opposite side of the duct board, a tape feeding system positioning the end of a supply of tape in line to be contacted by the lead end of the duct and pulled from the supply by the duct moving through the machine, said system including a tape facing take-up system for pulling the facing from the tape before it is applied to the board, means for activating the take-up system after the tape has been contacted by the leading end of the duct and de-activating the system after the trailing end of the duct has had tape applied thereto, a smoothing iron for applying the tape over the duct flap and adjacent portion of said other side of the duct board as the duct moves through the machine, cutter means for severing the tape applied to the duct free from the supply, means responsive to movement of the duct for operating said cutter means after the trailing end of the duct has passed the cutter means, and wiper means said tape into firm engagement with said duct board as the duct leaves the machine.

2. The machine of claim 1 wherein said wiper means is provided by a power-driven rotating paddle wheel having a plurality of flexible paddles thereon.

3. The machine of claim 1, wherein a staple gun is positioned to staple the flap to the other side of the duct board, and means are provided responsive to movement of the duct through the machine for initiating operation of the gun after the leading edge of the duct is opposite the gun and terminating operation of the gun as the trailing end of the duct approaches the gun.

4. The apparatus of claim 3, wherein said wiper means is provided by a power-driven rotating paddle wheel having a plurality of flexible paddles thereon.

5. The machine of claim 3, wherein the sled guide includes angular portions, one engaging each side of the duct board, to provide rigidity while stapes are being applied.

6. The machine of claim 1, wherein both the tape supply and tape facing take-up system are provided with adjustable tension means which allows the tape to unwind and flow on the duct uniformly and the facing to be pulled from the tape without hindering tape flow.

7. The machine of claim 1, wherein the cutter means is a shear passing through a slot in the smoothing iron.

8. The machine of claim 1, wherein said wiper means is provided by a power-driven rotating paddle wheel having a brake and a plurality of flexible paddles thereon, and means are provided responsive to movement of the duct through the machine for initiating rotation of said wheel before the duct reaches the wheel and terminating rotation of said wheel and applying said brake immediately prior to the trailing end of said duct reaching said wheel, said paddles as they engage said tape moving in the direction of movement of the duct to apply multiple wipes to each section of tape except the tape at the immediate trailing end of the duct which, after the wheel is stopped, is wiped by a fixed wheel.

9. A duct closing machine comprising, a plurality of rollers arranged to guide a duct board folded in duct form through the machine, said board having a flap of material on one side thereof, a sled guide on the machine bending and holding the flap on one side of the duct board in engagement with the opposite side of the duct board, a tape feeding system positioning the end of a supply of tape in line to be contacted by the lead end of the duct and pulled from the supply by the duct moving through the machine, a smoothing means for applying the tape over the duct flap and adjacent portion of said other side of the duct board as the duct moves through the machine, cutter means for severing the tape applied to the duct free from the supply, means responsive to movement of the duct for operating said cutter means after the trailing end of the duct has passed to the cutting means, and wiper means provided by a power driven rotating paddle wheel having a plurality of flexible paddles wiping said tape into firm engagement with said duct board as the duct leaves the machine, said wiper means wiping said tape several times as it passes through the machine.

10. The machine of claim 9, wherein a staple gun is positioned to staple the flap to the other side of the duct board, and means are provided responsive to movement of the duct through the machine for initiating operation of the gun after the leading edge of the duct is opposite the gun and terminating operation of the gun as the trailing edge of the duct approaches the gun.

11. The machine of claim 9, wherein said wiper means is provided with a brake and means are provided responsive to movement of the duct through the machine for initiating rotation of said wheel before the duct reaches the wheel and terminating rotation of said wheel and applying said brake immediately prior to the trailing end of said duct reaching said wheel, said paddles as they engage said tape moving in the direction of movement of the duct to apply multiple wipes to each section of tape except the tape at the immediate trailing end of the duct which, after the wheel is stopped, is wiped by a fixed wheel.

* * * * *

UNITED STATES PATENT OFFICE

CERTIFICATE OF CORRECTION

Patent No. 4,070,954 Dated January 31, 1978

Inventor(s) Ronald J. Cailey

It is certified that error appears in the above-identified patent and that said Letters Patent are hereby corrected as shown below:

In the Specification:

Column 3, line 59, change "idle" to -- idler --.

Column 4, line 49, change "is" to -- as --.

Column 5, line 52, change "tendancy" to -- tendency --.

In the Claims:

Column 6, Claim 1, line 49, after "and wiper means", add -- wiping --.

Signed and Sealed this

Sixth Day of June 1978

[SEAL]

Attest:

RUTH C. MASON
Attesting Officer

DONALD W. BANNER
Commissioner of Patents and Trademarks